United States Patent [19]

Mader et al.

[11] Patent Number: 4,724,730

[45] Date of Patent: Feb. 16, 1988

[54] WRENCH SOCKET WITH CAM LOCKING FEATURE

[75] Inventors: William G. Mader, York; James A. Van Lenten, Lancaster, both of Pa.

[73] Assignee: Easco Hand Tools, Inc., Hunt Valley, Md.

[21] Appl. No.: 841,315

[22] Filed: Mar. 19, 1986

[51] Int. Cl.[4] ..... B25B 13/50

[52] U.S. Cl. ..... 81/53.2; 81/90.2; 279/55

[58] Field of Search ..... 81/90.2, 92, 111–115, 81/53.2, 57.18, 443, 446, 183, 59.1; 269/231, 287, 48.1; 279/37, 38, 81, 107, 78, 71, 55, 72

[56] References Cited

U.S. PATENT DOCUMENTS

| | | | |
|---|---|---|---|
| 289,506 | 12/1883 | Davidson | 81/115 |
| 1,140,567 | 5/1915 | Boring | 81/111 |
| 2,403,613 | 11/1947 | Hodge | 269/231 |
| 3,413,876 | 12/1968 | Shinn | 81/53.2 |
| 4,611,513 | 9/1986 | Young | 81/53.2 |

*Primary Examiner*—Frederick R. Schmidt

*Assistant Examiner*—Bradley I. Vaught

*Attorney, Agent, or Firm*—Leonard Bloom

[57] ABSTRACT

A cam lock socket has a plurality of pins having substantially oval-shaped cross-sections. The pins are received in complementary axially-extending circumferentially-spaced scalloped recesses formed in the socket body. When the socket is rotated in one direction or another, the pins are cammed out of their respective recesses to tighten on a nut (or the head of a bolt or stud). Means are provided for retaining the pins axially and radially in the socket body, and to preclude the pins from tilting about their respective longitudinal axes.

In one embodiment, outwardly-extending fins on the pins are received in an internal annular groove formed in the socket body, and a resilient retaining ring is received in slots formed on the inside of pins. In another embodiment, a flanged bushing is mounted in the bore of the socket body and cooperates with inwardly-extending fins on the pins. The flange on the bushing carries a resilient O-ring which bears against the respective pins.

13 Claims, 13 Drawing Figures

WRENCH SOCKET WITH CAM LOCKING FEATURE

FIELD OF THE INVENTION

The present invention relates to a socket for use with a ratchet wrench or the like, and more particularly, to a wrench socket having a cam locking feature.

BACKGROUND OF THE INVENTION

In the prior art, there are various disclosures for providing a wrench socket, stud driver or stud removing tool adapted to tighten on a worn stud, bolt head or nut for quickly removing the same.

For example, U.S. Pat. No. 2,613,942 to Saunders discloses a stud driver having a plurality of cylindrical rollers mounted in a generally tubular cage retained within the tool body. The cage has roller retaining slots formed therein; and the slots have widths which are slightly less than the diameter of the rollers, thereby preventing the rollers from falling through the slots and into the bore of the cage, while permitting the rollers to project through the slots and into the bore to engage a stud positioned therein. Cam surfaces are provided on the inner surface of the housing; and rotation of the housing in either direction relative to the cage causes at least some of the cam surfaces to engage the rollers, thereby urging the roller radially inwardly to grip the stud received therein.

The prior art is also represented by the following U.S. Pats. Nos.: 1,140,567; 1,162,197; 2,063,344; 2,069,527; 2,105,788; 2,220,654; 2,408,335; 2,550,010; 2,833,547; 2,985,049; and 3,889,557.

These prior art mechanisms, as applied to a ratched wrench (or the like) are somewhat cumbersome, expensive to manufacture, or unreliable in their operation; and to the best of our knowledge and belief, have generally met with relatively limited commercial success in the marketplace.

SUMMARY OF THE PRESENT INVENTION

Accordingly, it is an object of the present invention to alleviate the disadvantages and deficiencies of the prior art by providing a cam lock socket which is elegant in its design, econmical to manufacture, and reliable in its operation.

It is another object of the present invention to provide a cam lock socket having a superior torque and gripping action, and wherein the force transmitted to the socket is distributed substantially equally.

In accordance with the teachings of the present invention, there is herein illustrated and described, a wrench socket having a cam locking feature and adapted for driving a nut or the like. The socket includes a body having a bore and further having a communicating counterbore formed therein. The counterbore has a plurality of axially-extending circumferentially-spaced scalloped recesses formed therein. A plurality of pins are received in the respective recesses, and each of the pins has a substantially oval cross-section complementary to the scalloped recesses, whereby a camming action is provided by co-action between the pins and the recesses. Means are provided for retaining the pins axially and radially within the body, but accommodating a camming of the pins out of their respective recesses upon rotation of the socket, thereby tightening on the nut.

The substantially oval cross-section of the pins, as distinguished from the circular cross-sections habitually resorted to in the prior art, provides a superior torque and gripping action on the nut; and the force transmitted to the socket through the pins is distributed substantially equally over substantially the entire contact area between each pin and the socket.

In a first embodiment, each oval-shaped pin has a radially-outermost side portion and a radially-innermost side portion. Radially-projecting fin means are formed on the radially-outermost side portion of each pin, and the body has an internal annular groove formed therein and communicating with the counterbore for receiving the fin means. The radially-innermost side portion of each pin has a transverse slot formed therein, and a retaining ring is received in the transverse slots in the respective pins. With this arrangement, the pins are retained axially and radially within the socket body.

Preferably, the radially-outermost side portion of each pin has respective ends, and the fin means includes a pair of spaced fins, one at each end of the radially-outermost side portion of the pin. Each pin has an axially intermediate portion, and the fins and the transverse slots are formed in the axially intermediate portion of each pin and within a plane substantially at right angles to the pins. Preferably, the axially intermediate portion of each pin constitutes the axial midpoint thereof. The scalloped recesses are substantially contiguous to one another. Additionally, the internal annular groove on the socket body is interrupted, circumferentially, and merges with the shallow portions of the respective scalloped recesses.

In a second embodiment, each of the pins includes an axially innermost end portion having respective radially-innermost and radially-outermost side portions, each of which has respective ends. The retaining means includes radially-projecting spaced fins formed on each end of both the radially-innermost and outermost side portions of the pins. The socket body has an internal annular groove formed therein to receive the respective fins on the ends of the radially-outermost side portions of the respective pins. A bushing is mounted in the bore of the socket body radially-inwardly of the respective fins on the ends of the radially-innermost side portions of the respective pins. The bushing has an annular flange extending radially outwardly therefrom; and the flange is disposed axially outwardly (or lower than) the respective fins on the ends of the radially-innermost side portions of the respective pins, but in relatively close proximity thereto. An O-ring is carried by an external annular groove formed in the flange on the bushing, and the O-ring bears against the respective pins. With this arrangement, the pins are retained axially and radially within the socket body, and the pins are precluding from tilting within the socket body.

In another aspect of the present invention, the wrench socket includes a body having an opening formed therein. The opening has plurality of axially-extending circumferentially-spaced recess means formed therein. A plurality of pins is received in the respective recess means; and cam means is provided by co-action between each pin and its respective recess means, such that the pins will be cammed out of their respective recesses upon either clockwise or counter-clockwise rotation of the socket, substantially uniformly, and without tilting of the respective pins. First means are formed between an intermediate axial portion of each pin and the body of the socket for thereby retaining the respective pins axially in the socket body; and second means are provided for engaging the intermediate axial portion of each pin for thereby retaining the pins radially in the socket body. The first and second means are on substantially opposite sides of each pin and in a plane substantially transverse of the axial bore in the socket body, and at least one of the first and second means exerts a resilient bias on the pins.

These and other objects of the present invention will become readily apparent from a reading of the following specification, taken in conjunction with the enclosed drawings.

GENERAL DESCRIPTION OF THE PREFERRED EMBODIMENTS

Figure 1:
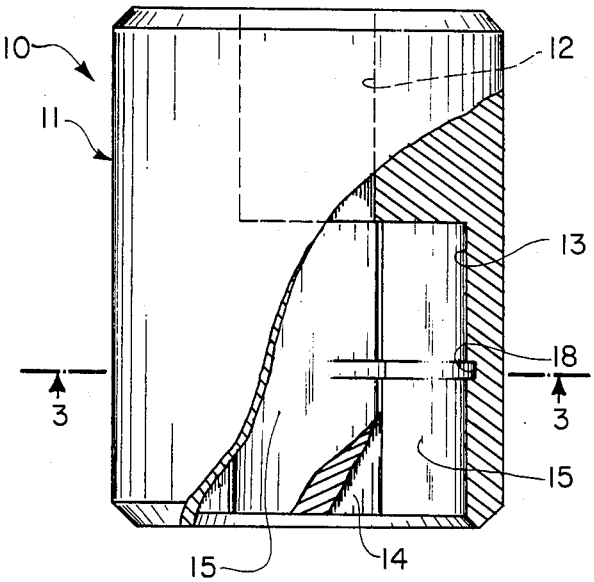
FIG. 1 is a front elevation, with parts broken away and sectioned, of a first embodiment of a wrench socket equipped with the cam locking feature of the present invention.
Figure 2:
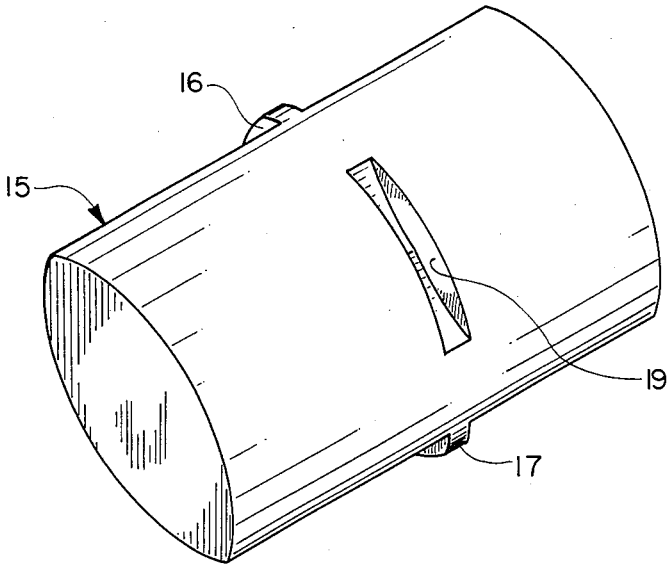
FIG. 2 is a perspective (drawn to an enlarged scale) of one of the pins used in the wrench socket of FIG. 1.
Figure 4:
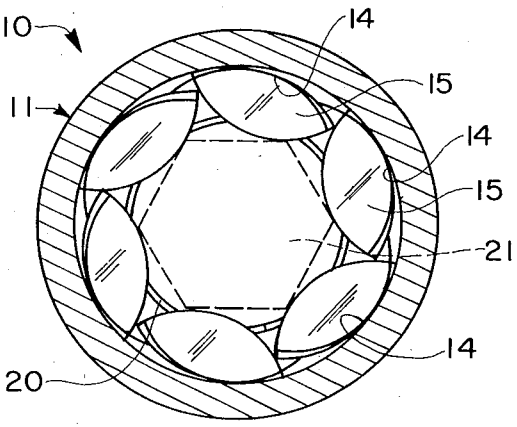
FIG. 4 is a further cross-sectional view, corresponding substantially to FIG. 3, but showing how the pins are cammed out of their respective recesses in the socket body open rotation of the wrench socket (in either a clockwise or counter-clockwise direction) to tighten on the stud, nut or bolt head.
Figure 6:
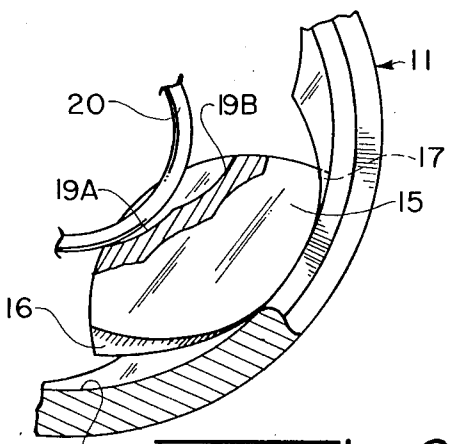
FIG. 6 is an enlarged portion of FIG. 4, corresponding substantially to FIG. 5.
Figure 3:
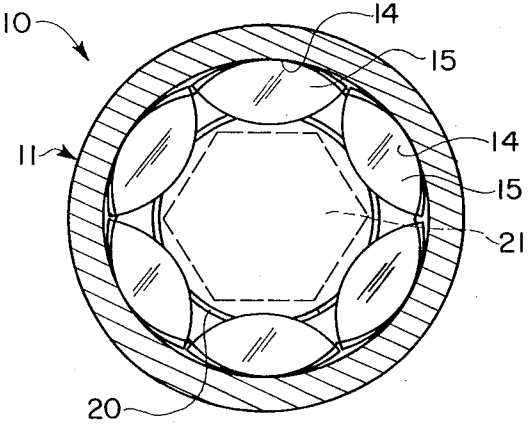
FIG. 3 is a cross-sectional view of the wrench socket, taken across the lines 3—3 of FIG. 1.
Figure 5:
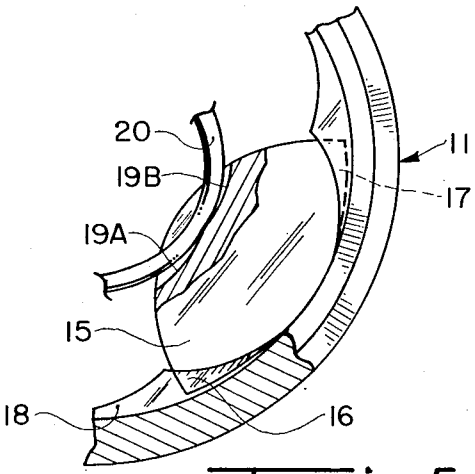
FIG. 5 is an enlarged portion of FIG. 3, showing the fins of the annular groove in the socket body, the transverse slot formed in the other side of the pin, and a portion of the resilient retaining ring received in the slot in the pin.
Figure 7:
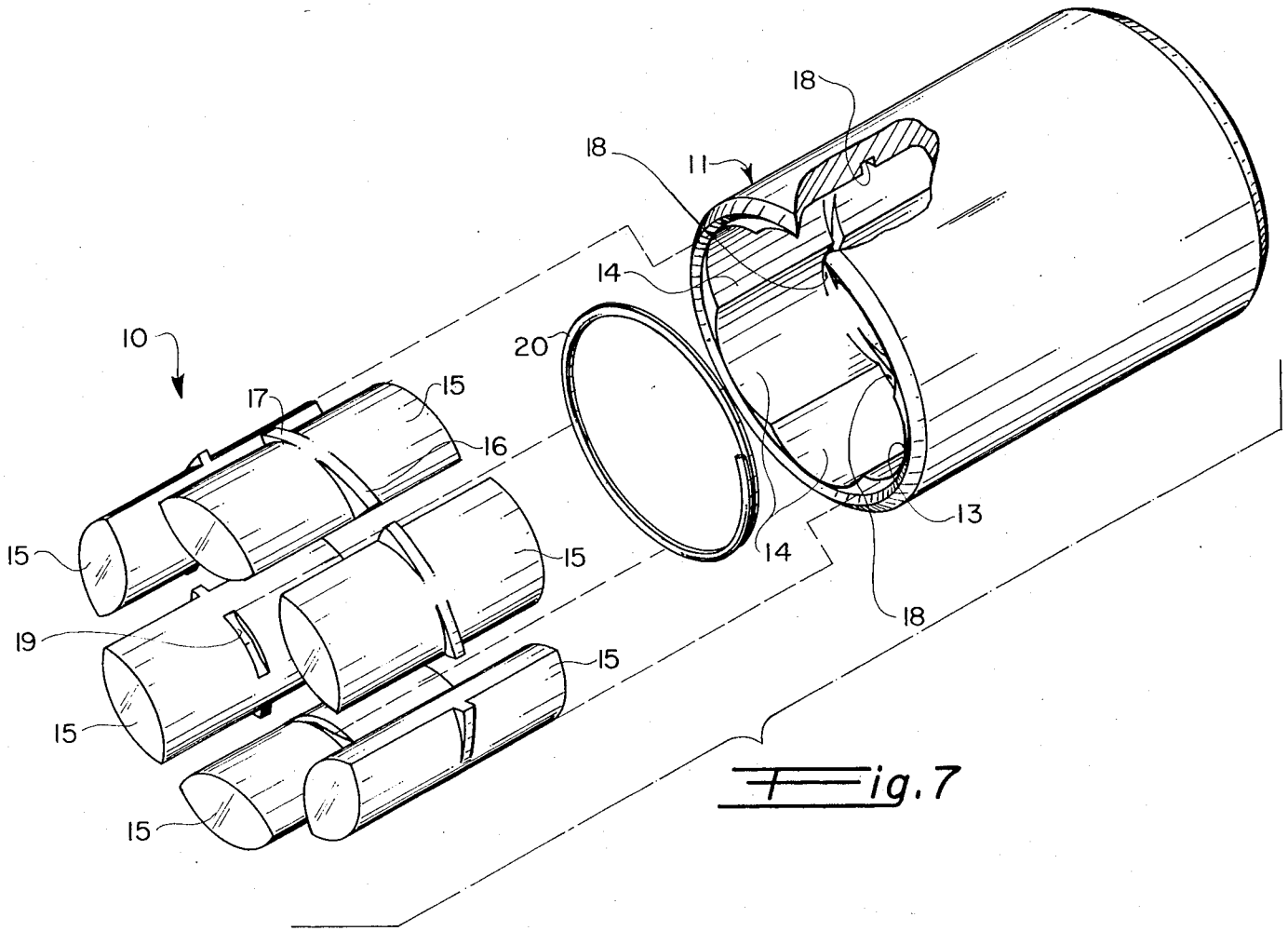
FIG. 7 is an exploded view of the cam lock socket, showing the socket body with its scalloped recesses and internal annular groove; the plurality of pins received in the respective recesses; the fins on the respective pins to be received in the internal annular groove, thereby retaining the pins axially in the socket body; and a resilient retaining ring received in respective slots on the pins, thereby retaining the pins radially in the socket body.
Figure 12:
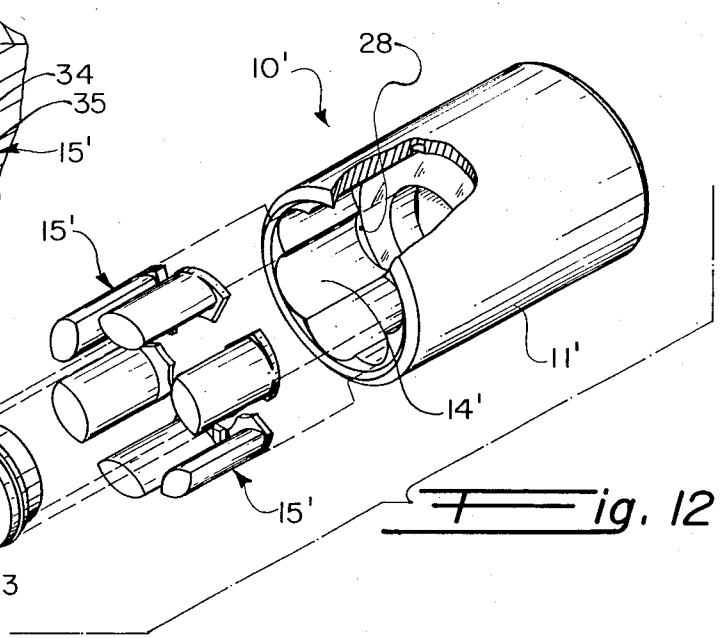
FIG. 12 is a exploded view of the components of the embodiment of FIG. 8.
Figure 11:
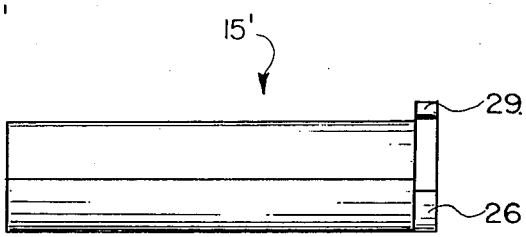
FIG. 11 is a side elevation thereof.
Figure 10:
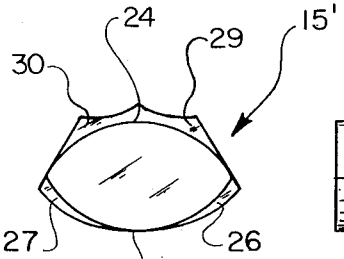
FIG. 10 is an end view of one of the pins used in the second embodiment of the invention shown in FIG. 8.

With reference to FIGS. 1–7, a wrench socket 10 has a body 11 provided with an axial bore 12 and a communicating counterbore or opening 13 formed therein. The bore 12 is formed in the top portion of the socket body and has a polygonal cross-section (preferably square) for receiving the drive stud or tang of a conventional ratchet wrench or other driving tool (not shown).

A plurality of circumferentially-arranged axially-extending recesses 14 are formed in the counterbore in the socket body. The recesses 14 are scalloped (as shown more clearly in FIG. 3 and 7) and preferably, are contiguous to one another. In the preferred embodiment, a total of six scalloped recesses 14 are formed in the socket body, although a different number of recesses are equally feasible consonant with the teachings of the present invention.

A plurality of pins 15 is received in the respective recesses. Each pin 15 has a substantially oval cross-section which is complementary to its respective scalloped recess. An axial intermediate portion of each pin has an outer side having respective end portions provided with respective radially-extending fins 16 and 17 (as shown more clearly in FIGS. 5, 6 and 7) and the fins 16 and 17 are substantially opposite to one another. An internal annular groove 18 is formed within the socket body radially of the respective recesses in communication with the counterbore in the socket body; and the respective fins 16 and 17 on each pin are received in the internal annular groove 18, thereby retaining the pins axially within the socket body. Preferably, the internal annular groove 18 is not continuous, but is interrupted circumferentially and merges with the shallow portion of each of the scalloped recesses, as shown more clearly in FIG. 7.

Each pin further has a transverse slot 19 formed therein on its inner side facing the interior of the axial bore in the socket body and substantially opposite to its respective recess. The slot 19 includes respective curved portions 19A and 19B (again as shown more clearly in FIGS. 5 and 6) and the slot portions 19A and 19B are substantially opposite to the fins on the pin and are arranged in a plane substantially transverse to the axial bore in the socket body. A resilient retaining ring 20 (sometimes referred to in the art as a "snap ring") is disposed within the axial bore in the socket body; and the ring 20 is received within the slots formed on the respective pins and exerts a resilient bias on the pins in a radial direction, thereby retaining the pins radially within the socket body.

In operation, when the socket 10 is rotated in one direction or another, that is, either clockwise or counter-clockwise, the pins 15 are cammed out of their respective scalloped recesses 14 substantially uniformly and without tilting about the longitudinal axis of the respective pins (as shown more clearly in FIGS. 4 and 6) to tighten on a nut 21 (shown in broken lines in the drawings) or on the head of a bolt or stud.

With reference to FIGS. 8–12, an alternate embodiment is illustrated, wherein the wrench socket 10' has a body 11' provided with a bore 22 and a communicating counterbore 22A. The bore 22 communicates with the opening 13' which, like the embodiment of FIGS. 1–17 has a square or polygonal cross-section to receive the drive stud or tang of a conventional ratchet wrench (not shown) or other driving tool. A plurality (preferably six) of axially-extending circumferentially-spaced scalloped recesses 14' is formed in the counterbore in the socket body, substantially contiguous to one another; these scalloped recesses 14' receive a corresponding plurality of pins 15'. Each of the pins 15' has a substantially oval cross-section and includes a radially-innermost side portion 24 and a radially-outermost side portion 25, each of which has respective ends, as shown more clearly in FIG. 10. A radially-outwardly projecting first pair of fins 26 and 27 is formed on the respective ends of the radially-outermost side portion 25 of each pin. The fins 26 and 27 are received in an internal annular groove 28 formed in the socket body. A radially-inwardly projecting second pair of fins 29 and 30 is formed on the radially-innermost side portion 24 of each pin. The fins 29 and 30 are radiused, as shown more clearly in FIG. 10, to accommodate rotation of the pins in either a clockwise or counterclockwise direction. The respective fins 26, 27, 29 and 30 are formed on the axial innermost end portion of each pin, as shown more clearly in FIGS. 8 and 11, and are arranged in a plane substantially transverse to the longitudinal axis of each pin.

Figure 8A:
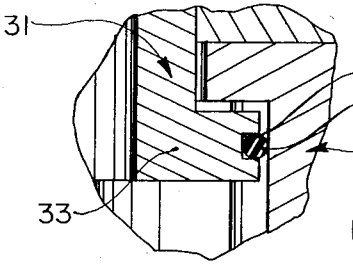
FIG. 8A is a portion of FIG. 8, drawn to an enlarged scale, and showing an O-ring carried in an external annular groove of a flange on a bushing, the O-ring bearing against the pins.
Figure 8:
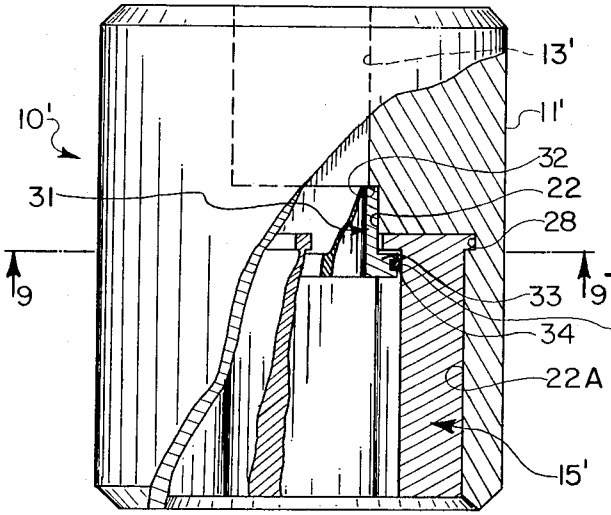
FIG. 8 a front elevation, with parts broken away and sectioned, of a second embodiment of a wrench socket equipped with the cam locking feature of the present invention.
Figure 9:
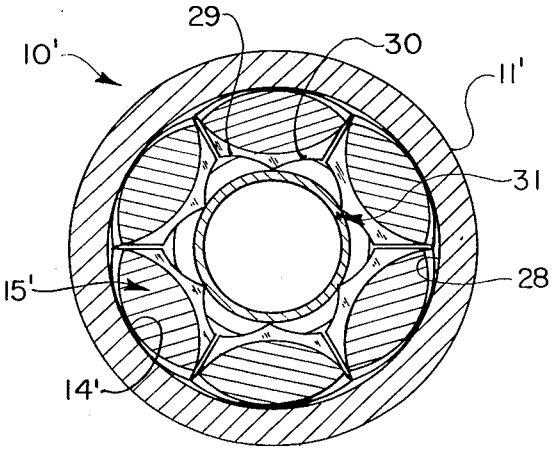
FIG. 9 is a cross-sectional view thereof, taken across the lines 9—9 of FIG. 8.

A bushing 31 is press-fitted (or otherwise secured) within the bore 22 in the socket body and has an innermost annular portion abutting against an annular shoulder or stop 32 (formed between the bore 22 and the opening 13') as shown more clearly in FIG. 8. The bushing 31 has an annular radially-projecting flange 33 disposed beneath the fins 29 and 30, that is, axially outwardly therefrom. The flange 33 is spaced from the fins 29 and 30, but is in relatively close proximity thereto. The flange 33 has an external annular groove 34 formed therein to receive a resilient O-ring 35. The O-ring 35 bears against the respective pins 15'.

With this arrangement, the pins 15' are retained axially and radially within the socket body and are precluded from tilting within the socket body and relative to their longitudinal axes, respectively, yet may be cammed out of their respective scalloped recesses 14' by co-action between the pins 15' and the recesses 14' to tighten on a nut, bolt head or stud upon rotation of the socket. The operation of the embodiment of FIGS. 8–12 is substantially identical to the operation of the embodiment of FIGS. 1–7.

The substantially oval cross-section of the respective pins 15 (or 15') results in a superior torque or gripping action on the nut, and is a decided advantage over the round or circular cross-sections usually resorted to in the prior art of stud removal tools. In addition, the force transmitted to the socket through the pins is distributed substantially equally over substantially the entire contact area between the socket and each respective pin.

Moreover, the pins 15 or 15' may be made economically, using readily-available powder metal technology, and expensive machining operations to fabricate the respective pins are obviated. On the other hand, the scalloped recesses 14 or 14' are conveniently formed by known broaching techniques. Assembly of the cam lock socket 10 or 10' is easy and convenient, and expensive jigs or fixtures are not necesary. Removal of the pins for replacement purposes is easily facilitated by merely removing the snap ring 20 of FIGS. 1–7 in the bushing 31 of FIGS. 8–12.

As a result, the cam lock socket of the present invention is economical to produce, provides increased torque for superior gripping, performs reliably, and may be easily serviced whenever necessary. Accordingly, the cam lock socket of the present invention may be produced on a volume basis for marketing and distribution through mass merchants and other merchandising channels for use, not only by professional mechanics, but also by do-it-yourselfers, homeowners and hobbyists.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A wrench socket having a cam locking feature and adapted for driving a nut or the like, comprising a body having a bore and a communicating counterbore formed therein, the counterbore having a plurality of axially-extending circumferentially-spaced scalloped recesses formed therein, a plurality of pins received in the respective recesses, the pins each having a substantially oval cross-section complementary to the scalloped recesses, providing a camming action between the pins and the recesses, and means for retaining the pins axially and radially within the body, said last-named retaining means accommodating a camming of the pins out of their respective recesses upon rotation of the socket, thereby tightening on the nut.

2. The wrench socket of claim 1, wherein the scalloped recesses are substantially contiguous to one another.

3. A wrench socket having a cam locking feature and adapted for driving a nut or the like, comprising a body having a bore and a communicating counterbore formed therein, the counterbore having a plurality of axially-extending circumferentially-spaced scalloped recesses formed therein, a plurality of pins received in the respective recesses, the pins each having a substantially oval cross-section complementary to the scalloped recesses, providing a camming action between the pins and the recesses, and means for retaining the pins axially and radially within the body, said last-named retaining means accommodating a camming of the pins out of their respective recesses upon rotation of the socket, thereby tightening on the nut, wherein each of the pins includes an axially innermost end portion having respective radially-innermost and radially-outermost side portions, each of which has respective ends; and wherein said retaining means comprises radially-projecting spaced fins formed on each end of both the radially innermost and radially outermost side portions of the pins, the socket body having an internal annular groove formed therein to receive the respective fins on the ends of the radially-outermost side portions of the respective pins, and a bushing mounted in the bore of the socket body radially inwardly of the respective fins on the ends of the radially-innermost side portions of the respective pins, the bushing having a flange extending radially-outwardly therefrom and disposed axially outwardly of the respective fins on the ends of the radially-innermost side portions of the respective pins and in relatively close proximity thereto, and the respective fins on the radially-innermost side portion of each pin being radiused to accommodate rotation of the pins in either a clockwise or counterclockwise direction.

4. A wrench socket having a cam locking feature and adapted for driving a nut or the like, comprising a body having a bore and a communicating counterbore formed therein, the counterbore having a plurality of axially-extending circumferentially-spaced scalloped recesses formed therein, a plurality of pins received in the respective recesses, providing a co-action between the pins and the recesses, each of the pins including an axially innermost end portion having respective radially-innermost and radially-outermost side portions, each of which has respective ends, radially-projecting spaced fins formed on each end of both the radially innermost and radially outermost side portions of the pins, the socket body having an internal annular groove formed therein to receive the respective fins on the ends of the radially-outermost side portions of the respective pins, a bushing mounted in the bore of the socket body radially inwardly of the respective fins on the ends of the radially-innermost side portions of the respective pins, the bushing having a flange extending radially therefrom and disposed axially outwardly of the respective fins on the ends of the radially-innermost side portions of the respective pins and in relatively close-proximity thereto, and wherein the co-action between the pins and the recesses provides a means for camming the pins out of their respective recesses upon turning of the socket body, substantially uniformly and without tilting relative to the axis of the pins, thereby tightening on the nut.

5. In a wrench socket, the combination of a body having an axial opening formed therein, the opening having a pluraltiy of axially-extending circumferentially-spaced recess means formed therein, a plurality of pins received in the respective recesses, each pin having a substantially oval cross-section substantially complementary to the scalloped recesses, cam means provided by the co-action between each pin and its respective recess, whereby the pins will be cammed out of their respective recesses upon either clockwise or counterclockwise rotation of the socket, subtantially uniformly and without tilting of the respective pins, each of the pins having an axial portion, first means formed between the axial portion of each pin and the body of the socket for thereby retaining the respective pins axially in the socket body, and second means engaging the axial portion of each pin for thereby retaining the pins radially in the socket body, the first and second means being on substantially opposite sides of each pin and in a plane substantially transverse of the axial opening in the socket body.

6. The combination of claim 5, wherein at least one of the first and second means exerts a resilient bias on the pins in a radial direction.

7. A wrench socket having a cam locking feature and adapted for driving a nut or the like, comprising, in combination, a body having an axial opening formed therein, the opening having a plurality of axially-extending circumferentially-spaced scalloped recesses formed therein, a plurality of pins received in the respective recesses, the pins each having a substantially oval cross-section, whereby co-action between the pins and the recesses permits the pins to be cammed out of their respective recesses upon either clockwise or counter-clockwise rotation of the socket, substantially uniformly and without tilting of the respective pins, first means for retaining the pins axially in the socket body, and second means for retaining the pins radially in the socket body.

8. A wrench socket having a cam locking feature and adapted for driving a nut or the like, comprising, in combination, a body having an axial opening formed therein, the opening having a plurality of axially-extending circumferentially-spaced recesses formed therein, a plurality of pins received in the respective recesses, the pins each having a substantially oval cross-section, whereby co-action between the pins and the recesses permits the pins to be cammed out of their respective recesses upon either clockwise or counter-clockwise rotation of the socket, substantially uniformly and without tilting of the respective pins, first means for retaining the pins axially in the socket body, second means for retaining the pins radially in the socket body, wherein the pins exert a superior torque or gripping action on the nut, and wherein the force transmitted to the socket body through the pins is distributed substantially equally over substantially the entire contact area between each pin and the socket body.

9. A wrench socket having a cam locking feature and adapted for driving a nut or the like, comprising a body having a bore and a communicating counterbore formed therein, the socket body including a top portion having a polygonal cross-sectional opening formed therein and communicating with the bore in the socket body, an annular shoulder between the bore and the polygonal opening, the counterbore in the socket body having at least one axially-extending recess formed therein, a pin received in the recess and having a cross-section substantially complementary to the recess, cam means provided by a co-action between the pin and its respective recess, whereby when the socket is placed over the nut, and the nut is received substantially within the counterbore in the socket body, and when the socket is rotated in one direction or another, the pin will be cammed out of its recess to tighten on the nut, the pin including an axially innermost portion having first fin means formed thereon and extending radially outwardly therefrom, the socket body having an internal groove formed therein to receive the first fin means, the axially innermost portion of the pin further having second fin means formed thereon and extending radially inwardly therefrom, and a bushing received in the bore of the socket body, the bushing having an axially innermost portion abutting adjacent the annular shoulder, and the bushing further having a radially outwardly extending portion disposed axially outwardly of the second fin means, spaced therefrom but in relatively close proximity thereto, whereby the pin is retained axially and radially within the socket body.

10. A wrench socket having a cam locking feature and adapted for driving a nut or the like, comprising a body having a bore and a communicating counterbore formed therein, the socket body including a top portion having a polygonal cross-sectional opening formed therein and communicating with the bore in the socket body, an annular shoulder between the bore and the polygonal opening, the counterbore in the socket body having at least one axially-extending recess formed therein, a pin received in the recess and having a cross-section substantially complementary to the recess, cam means provided by a co-action between the pin and its recess, whereby when the socket is placed over the nut, and the nut is received substantially within the counterbore in the socket body, and when the socket is rotated in one direction or another, the pin will be cammed out of its recess to tighten on the nut, the pin including an axially innermost portion having first fin means formed thereon and extending radially outwardly therefrom, the socket body having an internal groove formed therein to receive the first fin means, the axially innermost portion of the pin further having second fin means formed thereon and extending radially inwardly therefrom, and a bushing received in the bore of the socket body, the bushing having an axially innermost portion abutting adjacent the annular shoulder, and the bushing further having a radially outwardly extending portion disposed axially outwardly of the second fin means, spaced therefrom but in relatively close proximity thereto, whereby the pin is retained axially and radially within the socket body, wherein the radially outwardly extending portion of the bushing comprises an annular flange on the bushing, the flange having an external annular groove formed therein, and an O-ring in the bushing and bearing against the pins, respectively.

11. A wrench socket having a cam locking feature and adapted for driving a nut or the like, comprising a body having a bore and a communicating counterbore formed therein, the socket body including a top portion having a polygonal cross-sectional opening formed therein and communicating with the bore in the socket body, an annular shoulder between the bore and the polygonal opening, the counterbore in the socket body having at least one axially-extending recess formed therein, a pin received in the recess and having a cross-section substantially complementary to the recess, cam means provided by a co-action between the pin and its recess, whereby when the socket is placed over the nut, and the nut is received substantially within the counterbore in the socket body, and when the socket is rotated in one direction or another, the pin will be cammed out of its recess to tighten on the nut, the pin including an axially innermost portion having first fin means formed thereon and extending radially outwardly therefrom, the socket body having an internal groove formed therein to receive the first fin means, the axially innermost portion of the pin further having second fin means formed thereon and extending radially inwardly therefrom, and a bushing received in the bore of the socket body, the bushing having an axially innermost portion abutting adjacent the annular shoulder, and the bushing further having a radially outwardly extending portion disposed axially outwardly of the second fin means, spaced therefrom but in relatively close proximity thereto, whereby the pin is retained axially and radially within the socket body, wherein a plurality of axially-extending recesses are formed in the socket body, the recesses being spaced circumferentially within the socket body and substantially contiguous to each other, each of the recesses being substantially scalloped in a plane transverse to the axis of the socket body; wherein a corresponding plurality of pins are received in the respective scalloped recesses, each of the pins having a substantially oval cross-section substantially complementary to its respective scalloped recess; and wherein the radially outwardly extending portion of the bushing comprises an annular flange engaging the second fin means of the respective pins.

12. A wrench socket having a cam locking feature and adapted for driving a nut or the like, comprising a body having a bore and a communicating counterbore formed therein, the socket body including a top portion having a polygonal cross-sectional opening formed therein and communicating with the bore in the socket body, an annular shoulder between the bore and the polygonal opening, the counterbore in the socket body having at least one axially-extending recess formed therein, a pin received in the recess and having a cross-section substantially complementary to the recess, cam means provided by a co-action between the pin and its recess, whereby when the socket is placed over the nut, and the nut is received substantially within the counterbore and in the socket body, and when the socket is rotated in one direction or another, the pin will be cammed out of its recess to tighten on the nut, the pin including an axially innermost portion having first fin means formed thereon and extending radially outwardly therefrom, the socket body having an internal groove formed therein to receive the first fin means, the axially innermost portion of the pin further having second fin means formed thereon and extending radially inwardly therefrom, and a bushing received in the bore of the socket body, the bushing having an axially innermost portion abutting adjacent the annular shoulder, and the bushing further having a radially outwardly extending portion disposed axially outwardly of the second fin means, spaced therefrom but in relatively close proximity thereto, whereby the pin is retained axially and radially within the socket body, wherein each of the pins has a radially innermost and a radially outermost side portion, wherein the first fin means comprises a pair of fins formed on the radially outermost side portion of the pin, and wherein the second fin means comprises a pair of fins formed on the radially innermost side portion of each pin.

13. A wrench socket having a cam locking feature and adapted for driving a nut or the like, comprising a body having a bore and a communicating counterbore formed therein, the socket body including a top portion having a polygonal cross-sectional opening formed therein and communicating with the bore in the socket body, an annular shoulder between the bore and the polygonal opening, the counterbore in the socket body having a plurality of axially-extending recesses formed therein, the recesses being spaced circumferentially within the socket body and being substantially contiguous to each other, each of the recesses being substantially scalloped in a place transverse to the axis of the socket body, a corresponding plurality of pins received in the respective scalloped recesses, each of the pins having a substantially oval cross-section substantially complementary to its respective scalloped recess, providing a co-action between the pins and the recesses, whereby when the socket is placed over the nut, and the nut is received substantially within the counterbore in the socket body, and when the socket is rotated in one direction or another, wherein the co-action between the pins and the recesses permits the pins to be cammed out of their respective recesses, substantially uniformly and without tilting of the pins, to tighten on the nut, each of the pins including an axially innermost portion having a first pair of fins formed thereon and extending radially outwardly therefrom, the socket body having an internal annular groove formed therein to receive the first pair of fins, the axially innermost portion of each pin further having a second pair of fins formed thereon and extending radially inwardly therefrom, and a bushing press-fitted in the bore of the socket body, the bushing having an axially innermost annular portion abutting against the annular shoulder, the bushing further having a radially outwardly extending annular flange disposed axially outwardly of the second pair of fins, spaced therefrom but in relatively close proximity thereto, the annular flange on the bushing having an external annular groove formed therein, and a resilient O-ring within the groove and bearing against the pins, respectively, whereby the pins are retained axially and radially within the socket body and are precluded from tilting relative to the socket body, and whereby the pins are cammed out of their respective scalloped recesses upon rotation of the socket body to clamp on a nut.

* * * * *